United States Patent [19]

Berendsen et al.

[11] 4,028,110

[45] June 7, 1977

[54] DEVELOPMENT OF EXPOSED LITH-EMULSIONS

[75] Inventors: Jules Robert Berendsen, Deurne; Robert Joseph Pollet, Vremde; Herman Adelbert Philippaerts, Edegem; Francis Jeanne Sels, Kontich; Jozef Frans Willems, Wilrijk, all of Belgium

[73] Assignee: AGFA-GEVAERT, N.V., Mortsel, Belgium

[22] Filed: Feb. 21, 1975

[21] Appl. No.: 552,037

[30] Foreign Application Priority Data

Feb. 28, 1974 United Kingdom ..... 9106/74

[52] U.S. Cl. ..... 96/66.3; 96/107

[51] Int. Cl.[2] ..... G03C 5/30; G03C 1/28

[58] Field of Search ..... 96/66.3, 66.5, 107

[56] References Cited

UNITED STATES PATENTS

| | | | |
|---|---|---|---|
| 2,275,727 | 3/1942 | Carroll et al. | 96/107 |
| 2,288,226 | 6/1942 | Carroll et al. | 96/107 |
| 2,944,900 | 7/1960 | Carroll et al. | 96/107 |
| 2,944,902 | 7/1960 | Carroll et al. | 96/107 |
| 3,017,270 | 1/1962 | Tregillus et al. | 96/66.3 |
| 3,518,085 | 6/1970 | Milton et al. | 96/66.3 |
| 3,847,618 | 11/1974 | Hofman et al. | 96/66.3 |

*Primary Examiner*—Mary F. Kelley
*Attorney, Agent, or Firm*—A. W. Breiner

[57] ABSTRACT

A method of developing an exposed lith-type silver halide emulsion is described wherein development takes place in the presence of a sulphonium compound corresponding to the formula:

wherein:

each of $X_1$ and $X_2$ represents an alkyl group at least one of which carries a hydroxy, carboxy, sulpho or cyano group, R represents an alkyl group, an aryl group or the group wherein A is a divalent organic group, or R may represent hydrogen when both $X_1$ and $X_2$ are hydroxyalkyl,

*n* is an integer of at least 1 when the compound is a disulphonium compound and is an integer of at least 2 when the compound is a monosulphonium compound, and Z is an anion but does not exist when one of $X_1$ and $X_2$ itself contains an anionic group.

11 Claims, No Drawings

DEVELOPMENT OF EXPOSED LITH-EMULSIONS

This invention relates to development of exposed lith-type silver halide emulsions in the presence of development modifying agents.

In the photomechanical arts, lith type emulsions are used for the preparation of the line and half-tone film intermediates for making printing plates. In reproducing continuous tone material it is customary to make half-tone images in which the gradations in tone are represented by different sizes of dots of uniform density. The shape, density and uniformity of the half-tone dots are closely correlated to the quality of the resulting picture.

Lith emulsions have a characteristic curve with a short toe and high gamma and produce sharply defined images with high density extending to the edges of lines and dots. This applies especially when the "lith"-type developer is used, which comprises as the only developing agent hydroquinone or a hydroquinone derivative, and which has a very low sulphite ion content, the sulphite ion content being maintained at a low and constant value by the addition to the sulphite containing developing solution of formalin (paraformaldehyde) or by the direct addition to the solution of the addition product of sulphite and formalin namely formaldehydebisulphite.

The properties of lith type developers are believed to result from autocatalytic action, often called "infectious development" due to local high concentrations of the developing agent's oxidation products. The lith type silver halide emulsions which show these properties with lith-type developers are high-contrast fine grain silver halide emulsions which contain at least about 50 mole % of silver chloride and at least about 5 mole % of silver bromide; the silver halide can also contain up to 5 mole %, preferably less than 1 mole % of silver iodide. Such emulsions are referred to herein as lith type emulsions.

It is known to employ in the development of photographic silver halide emulsions development accelerating compounds which may be present in the emulsion and/or in the developer. These compounds include polyoxyalkylene compounds and onium compounds e.g. ammonium, phosphonium and sulphonium compounds.

As is described in German Pat. Spec. No. 1,141,531 filed Jan. 24, 1962 by Perutz Photowerke G.m.b.H., these compounds can also be used in the lith-development of lith-emulsions. The polyoxyalkylene compounds generally increase the gradation while restraining development whereas the onium compounds accelerate development so that they can neutralize the development retardation caused by the polyoxyalkylene compounds.

Onium compounds suitable for increasing the speed of non lith emulsions by development acceleration are not always satisfactory for use in lith-emulsion.

According to British Pat. Specification No. 1,098,748 filed Apr. 1, 1965 by Kodak Ltd., improved results can be obtained when using select pyridinium salts. However, these pyridinium salts do not always increase the initial rate of development to the desired extent e.g. as desired for lith-materials used in phototypesetting.

It has now been found that when development of an exposed "lith"-type silver halide emulsion is carried out in the presence of at least one ternary mono- or disulphonium compound corresponding to the general formula hereinafter, the initial rate of development is markedly increased which results in higher speed. Moreover, it was found that as compared with known onium compounds the speed obtained has high stability upon prolonged development which means that high development latitude is obtained. When used for recording screened images, improved dot-quality and high dot sharpness are obtained.

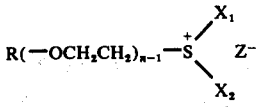

wherein:

each of $X_1$ and $X_2$ (which may be same or different) stands for an alkyl group, preferably a $C_1$–$C_5$ alkyl group, at least one of which is substituted by hydroxy, carboxy, sulpho or cyano, R represents an alkyl group, an aryl group or the group

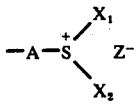

wherein A stands for a divalent organic group e.g. a $C_2$–$C_6$ alkylene group, a hydroxyalkylene group and a xylylene group, or R may represent hydrogen when both $X_1$ and $X_2$ are hydroxyalkyl,

*n* stands for an integer of at least 1 when the compound is a disulphonium compound

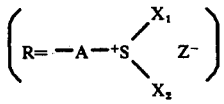

and of at least 2 when the compound is a monosulphonium compound (R=H, alkyl or aryl), and Z is an anion e.g. a halide ion, a perchlorate ion, a p-toluene sulphonate ion and an alkylsulphate ion but does not exist when one of $X_1$ and $X_2$ itself contains an anionic group.

In accordance with the present invention the sulphonium compounds are preferably incorporated in the silver halide lith type emulsion but they may also be present in the developer.

The present invention thus provides a method of developing an exposed lith-type silver halide emulsion containing at least about 50 mole % of silver chloride, at least about 5 mole % of silver bromide and from 0 to 5 mole % of silver iodide in the presence of a sulphonium compound corresponding to the above general formula. The present invention also provides such lith-type silver halide emulsions comprising sulphonium compounds of the type defined.

Representative examples of sulphonium compounds corresponding to the above general formula are:

1. 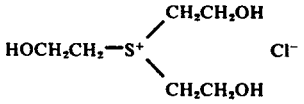
2. 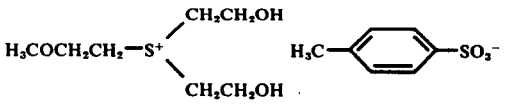
3. 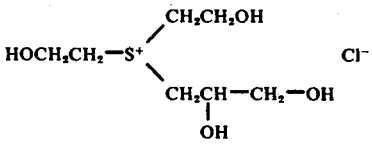
4. 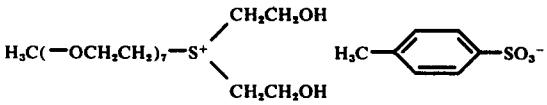
5. 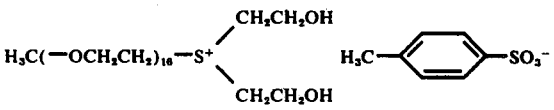
6. 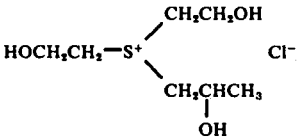
7. 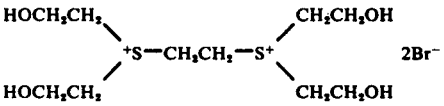
8. 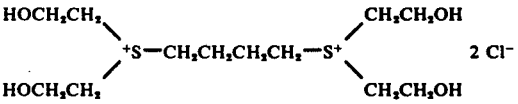
9. 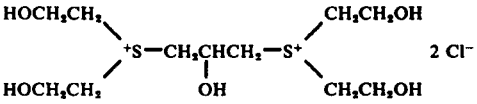
10. 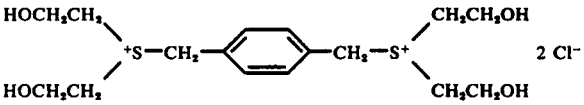
11. 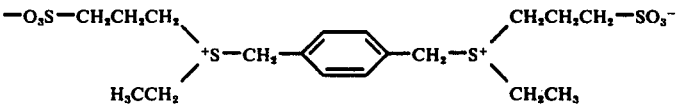
12. 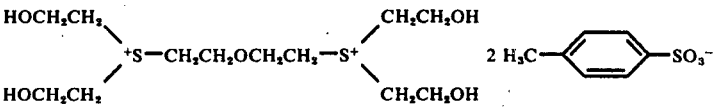
13. 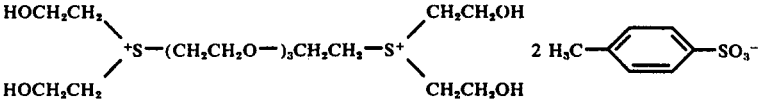
14. 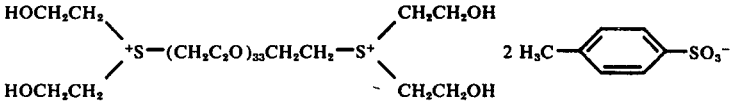

-continued

15. 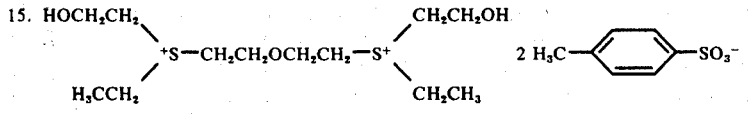

16. 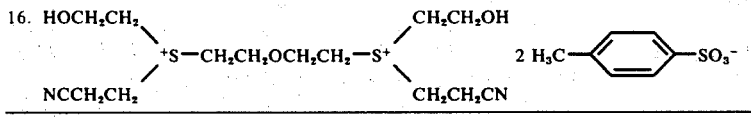

The sulphonium compounds can be prepared by methods known to those skilled in the art and as illustrated by the following preparations.

PREPARATION 1: COMPOUND 2

A mixture of 92 g of the toluene sulphonic acid ester of ethylene glycol monomethyl ether and 48.8 g of thiodiglycol was heated for 5 hours at 100° C. The viscous mixture obtained was washed three times with acetone and three times with ethyl acetate whereupon it was dried under reduced pressure. Yield: 90 g of viscous product.

PREPARATION 2: COMPOUND 4

A mixture of 60.5 g of the toluene sulphonic acid ester of polyethylene glycol (average molecular weight 350) monomethyl ether and 14.5 g of thiodiglycol was heated for 8 hours at 100° C. The viscous product was washed three times with ethyl acetate and dried under reduced pressure. Yield: 40 g of viscous product.

PREPARATION 3: COMPOUND 7

A mixture of 94 g of 1,2-dibromoethane and 122 g of thiodiglycol was heated for 6 hours at 110° C. Two layers formed and the mixture was washed three times with acetone. After drying under reduced pressure, 116 g of viscous product was obtained.

PREPARATION 4: COMPOUND 11

A mixture of 22.6 g of 1,4-bis(ethylthio)xylene and 24.4 g of propane sultone was heated for 6 hours at 80° C and then kept for 4 hours at 110° C. The mixture was kneaded with acetone and the hygroscopic precipitate was filtered off by suction and dried under reduced pressure. Yield: 46.5 g of white amorphous product.

PREPARATION 5: COMPOUND 12

A mixture of 414 g of the ditoluene sulphonic acid ester of diethylene glycol and 244 g of thiodiglycol was heated for 5 hours at 100° C. Yield: 650 g of viscous product.

PREPARATION 6: COMPOUND 15

A mixture of 41.4 g of the ditoluene sulphonic acid ester of diethylene glycol and 21.2 g of ethyl hydroxyethyl thioether was heated for 5 hours at 100° C. Yield: 62 g of viscous product.

PREPARATION 7: COMPOUND 16

A mixture of 41.4 g of the ditoluene sulphonic acid ester of diethylene glycol and 26.2 g of hydroxyethyl cyanoethyl thioether was heated for 6 hours at 110° C. After having been cooled the mixture was dissolved in methylene chloride. The product formed by precipitation in ether was dried under reduced pressure. Yield: 46 g of viscous product.

A particularly useful embodiment of the present invention is to use the sulphonium compounds in combination with polyalkylene glycols more particularly polyethylene glycols or with other polyoxyalkylene compounds known for use in the development of lith type emulsions e.g. alkylene oxide polymers obtained by polymerising alkylene oxide in the presence of hexitol ring dehydration products, aliphatic alcohols, aliphatic acids, amines, amides, phenols, etc. (cfr. U.S. Pat. Nos. 2,240,472 of Donald R. Swan issued Apr. 29, 1941, U.S. Pat. No. 2,423,549 of Ralph Kingsley Blake, William Alexander Stanton and Ferdinand Schulze, issued July 8, 1947, U.S. Pat. No. 2,400,532 of Ralph Kingsley Blake and Walter Deney Baldsiefen issued May 21, 1946 and U.S. Pat. No. 2,716,062 of Burt H. Carroll and Norman F. Beach issued Aug. 23, 1955, British Pat. Specification No. 748,745 filed June 28, 1954 by Kodak Co. and British Pat. Application No. 26250/73 filed June 1, 1973 by Agfa-Gevaert N.V.). The polyoxyalkylene compounds have a molecular weight of at least 300, preferably at least 1500 and can be present in the emulsion or in the developer or in both.

The optimum concentration of sulphonium compound to be used in accordance with the present invention can easily be determined by some simple tests. Their concentration can vary within wide limits according to the desired effect, the nature of the colloid binding agent for the silver halide as well as the particular compound and silver halide used. Generally, they are used in amounts comprised between about 5 mg and about 2 g, preferably between about 10 mg and about 1 g per mole of silver halide.

The polyoxyalkylene compounds can be employed in the amounts conventionally used in the lith-type emulsions and developers.

The sulphonium compounds corresponding to the above general formula are effective in the development of lith type emulsions by means of lith developers of the type described hereinbefore as well as other high contrast developers e.g. p-monomethylaminophenol-hydroquinone developers or developers for lith-emulsions of the kind described in U.S. patent application Ser. No. 226,232 Feb. 14, 1972 by Gerard Laurens Vanreusel and Raoul Jan Bortels, which comprise hydroquinone as the sole developing agent, sulphite in an amount of at least 5 g per liter and a nitroindazole or nitrobenzimidazole compound as development restrainer. Another suitable development restrainer for use in the development of lith-emulsions is 1H-6-methyl-benzotriazole.

The silver halide lith type emulsions can be chemically sensitized by any of the accepted procedures. They can be chemically sensitized by effecting the ripening in the presence of small amounts of sulphur containing compounds such as allyl thiocyanate, allyl thiourea, sodium thiosulphate, etc. The emulsions may also be sensitized by means of reductors for instance tin compounds as described in our British Pat. Specification No. 789,823 filed Apr. 29, 1955 by Gevaert Photo-Producten N.V. and small amounts of noble metal compounds such as gold, platinum, palladium, iridium, ruthenium and rhodium compounds. Of course, these three types of chemical sensitizers may be used simultaneously.

The lith-type emulsions may be used without being spectrally sensitized, however, it is advantageous to spectrally sensitize them according to methods well known in the art to make then ortho-sensitized or panchromatically sensitized. Spectral sensitizers that can be used are e.g. the cyanines, merocyanines, complex (trinuclear) cyanines, complex (trinuclear) merocyanines, styryl dyes, oxonol dyes and the like. Suchlike spectrally sensitizing dyes have been described by F. M. Hamer in "The cyanine dyes and related compounds" (1964). Especially suitable are the cyanines and merocyanines described in French Pat. Nos. 1,073,968 filed Oct. 22, 1952 by Farbenfabriken Bayer, 2,075,675 filed Jan. 15, 1971 by Agfa-Gevaert N.V., 2,080,479 and 2,080,480 both filed Jan. 28, 1971 by Agfa-Gevaert N.V., British Pat. Specifications Nos: 654,683 filed Feb. 24, 1948 by Kodak Ltd. and 1,090,626 filed Oct. 11, 1965 by Agfa A.G. and Belgian Pat. No. 654,816 filed Oct. 26, 1964 by Agfa A.G., 701,921 filed July 27, 1967, 716,831 filed June 19, 1968 both by Konishiroku Photo Industry and 723,720 filed Dec. 12, 1968 by Kodak Ltd.

Typical examples of suitable spectrally sensitizing dyes are:

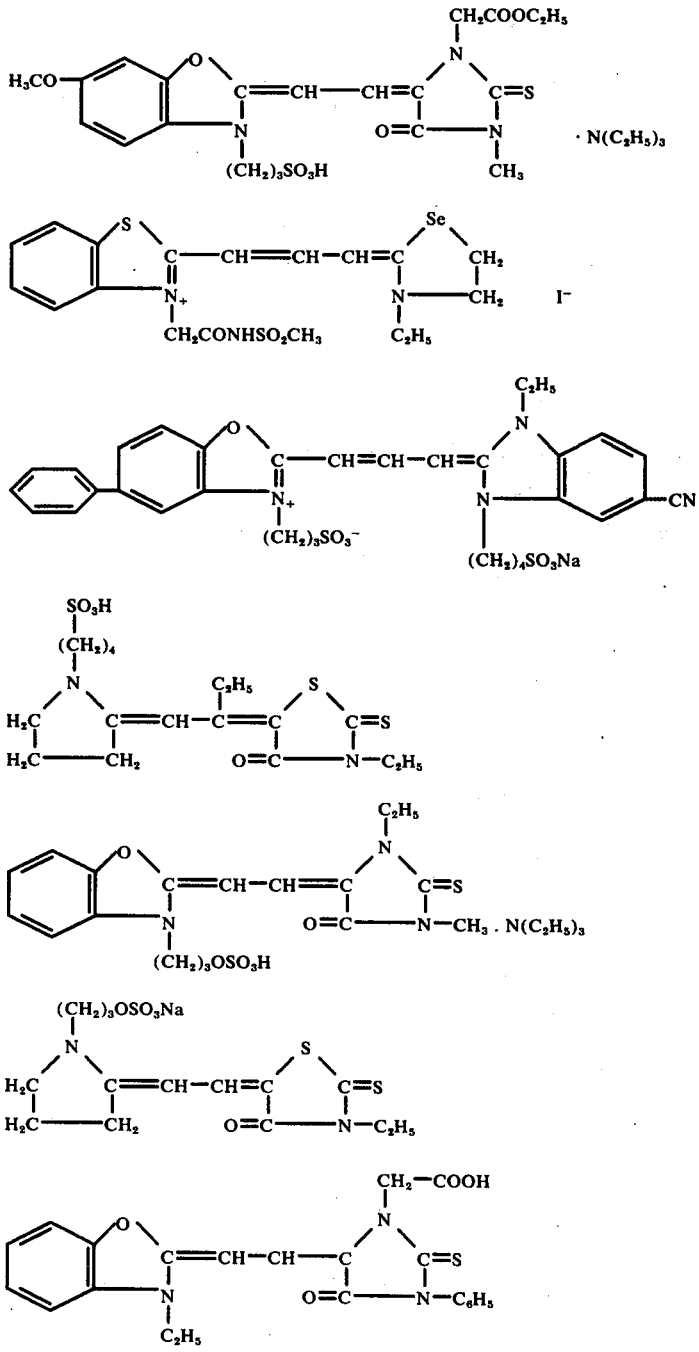

-continued

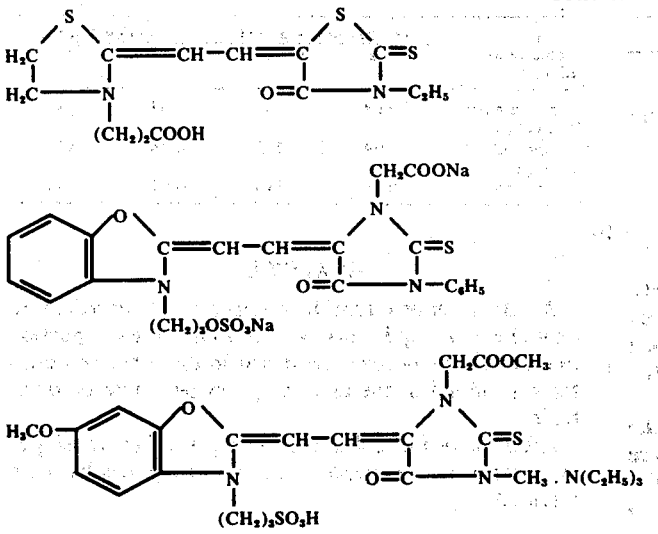

The lith-type silver halide emulsions can also contain conventional addenda for example, plasticizers, coating aids, fog-inhibiting or emulsion stabilizing compounds for which purpose it is preferred to use cadmium salts but other compounds can be used instead or in addition thereto e.g. mercury compounds, triazoles, tetrazoles e.g. 5,5'-tetramethylene-bistetrazole, azaindenes such as those described in Birr, Z.Wiss.Phot. Vol. 47, 1952, p-2-28, disulphides and quaternary benzothiazolium compounds, further hardeners such as aldehyde hardeners e.g., formaldehyde, mucochloric acid, glutaraldehyde bis(sodium hydrogen sulphite), maleic dialdehyde, aziridines, dioxan derivatives, and oxypolysaccharides. It is also preferred to use in the emulsions or developer iodonium compounds as described in British Pat. Specification No. 1,199,075 filed Oct. 7, 1965 by Gevaert-Agfa N.V. especially iodonium compounds corresponding to the formula:

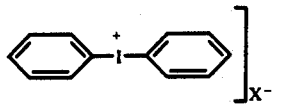

and

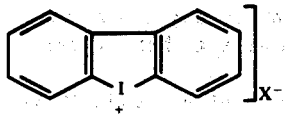

wherein $X^-$ represents an anion e.g. a halogen anion, a nitrate anion, a bisulphate anion or a benzotriazolium anion and wherein the aromatic nuclei may carry substituents e.g. alkyl, halogen, alkoxy, cyano, acyl or acylamino.

The silver halides can be dispersed in the common hydrophilic colloids such as gelatin, casein, zein, polyvinyl alcohol, carboxymethyl cellulose, alginic acid etc. gelatin being, however, preferred.

The silver halide lith-type emulsions may be coated on a wide variety of supports. Hydrophilic colloid layers can be coatd on one or both sides of the support, if desired. Typical supports are cellulose nitrate film, cellulose ester film, polyvinyl acetal film, polystyrene film, poly (ethylene terephthalate) film, and related films of resinous materials, as well as glass, paper, metal and the like. Supports such as paper, which are coated with α-olefin polymers, particularly polymers of α-olefins containing two or more carbon atoms, as exemplified by polyethylene, polypropylene, ethylenebutene copolymers and the like can also be employed.

Usually the silver halide emulsion layer is overcoated with a gelatin antistress layer which may comprise antifogging agents, antistatic agents, coating aids, e.g. coating aids of the type described in British Pat. Specification No. 1,178,546 filed Oct. 12, 1966 by Agfa-Gevaert N.V. and in French Patent Specification 2,025,688 filed December 8, 1969 by Gevaert-Agfa N.V., and dimethylpolysiloxan-polyethylene oxide copolymers in an amount of at least 2 % by weight relative to the gelatin.

The following examples illustrate the present invention.

EXAMPLE 1

A silver chlorobromide (16 mole % of bromide) gelatin emulsion chemically sensitized by means of a sulphur and gold compound and containing a cadmium compound, an iodonium compound according to British Pat. Specification No. 1,119,075, as mentioned hereinbefore, and a spectrally sensitizing dye was split into four portions and the following compounds were added to the emulsion:

| Coating | |
|---|---|
| A | - control (no onium compound added) |
| B | - 75 mg of 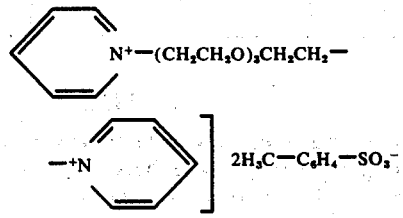 per mole of silver halide |
| C | - 75 mg of 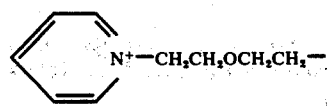 |

-continued

| Coating | |
|---|---|
| | 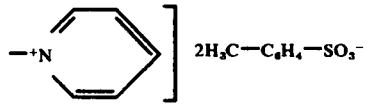 |
| D | per mole of silver halide - 75 mg of sulphonium compound 11 per mole of silver halide |

Each of the above portions was coated under identical circumstances on a conventional film support, exposed on an intensity scale sensitometer and developed for 1½ and 2½ min respectively at 27° C in a hydroquinone/formaldehyde bisulphite lith-developer.

The values of speed and fog obtained are listed in the following table. The values given for the speed are relative values for the speed measured at density 2; the value 100 is given to the speed of the control after 1½ min of development.

| coating | 1½ min. development fog | 1½ min. development rel.speed | 2½ min. development fog | 2½ min. development rel.speed |
|---|---|---|---|---|
| A | 0.04 | 100 | 0.04 | 1480 |
| B | 0.04 | 132 | 0.04 | 1380 |
| C | 0.04 | 166 | 0.05 | 1480 |
| C | 0.04 | 1320 | 0.06 | 1410 |

The above results show that the sulphonium compound as compared with known pyridinium compounds has a markedly higher increasing effect on the initial rate of development. It is further shown that upon prolonged development coating D shows no marked further increase in speed as compared with the other coatings.

When the coatings were developed for 2 min. at 27° C in a p-monomethylaminophenol/hydroquinone developer. It was also found that the sulphonium compound has a high development accelerating effect as is illustrated in the following table.

| coating | fog | relative speed | gamma |
|---|---|---|---|
| A | 0.04 | 100 | 2.80 |
| B | 0.04 | 1000 | 2.72 |
| C | 0.04 | 1100 | 3.80 |
| D | 0.05 | 1320 | 3.80 |

EXAMPLE 2

A silver chlorobromide emulsion as decribed in example 1 was split into three portions. To each portion one of the compounds identified in the table hereinafter was added in the amount given per mole of silver halide.

After exposure and development in a lith developer as described in example 1 the following results were attained.

| Compound added | 1½ min development fog | 1½ min development rel.speed | 2 min development fog | 2 min development rel.speed |
|---|---|---|---|---|
| none (control) | 0.04 | 100 | 0.04 | 340 |
| 150 mg of compound 7 | 0.04 | 282 | 0.04 | 480 |
| 70 mg of compound 11 | 0.04 | 515 | 0.04 | 550 |

EXAMPLE 3

A silver chlorobromide emulsion as described in example 1 was split into two portions. To each portion one of the compounds identified in the table hereinafter was added in the amount given per mole of silver halide.

After exposure and development in a lith developer as described in example 1 the following results were attained.

| compound added | 1½ min. development fog | 1½ min. development rel.speed | 2 min. development fog | 2 min. development rel.speed. | 2½ min. development fog | 2½ min. development rel.speed |
|---|---|---|---|---|---|---|
| none (control) | 0.04 | 100 | 0.04 | 263 | 0.04 | 250 |
| 75 mg of compound 2 | 0.04 | 230 | 0.04 | 250 | 0.04 | 240 |

The above results show that compound 2 increases the initial rate of development and that the speed remains approximately the same upon prolonged development.

We claim:

1. A method of developing an exposed photographic element including a lith silver halide emulsion containing at least about 50 mole % of silver chloride, at least about 5 mole % of silver bromide and from 0 to 5 mole % of silver iodide wherein during development a sulphonium compound corresponding to the formula:

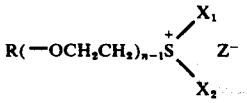

wherein:

each of $X_1$ and $X_2$ represents an alkyl group at least one of which carries a hydroxy, carboxy, sulpho or cyano group, R represents an alkyl group, an aryl group or the group

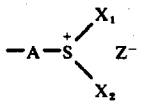

wherein A is a divalent organic group, or

R may represent hydrogen when $X_1$ and $X_2$ are hydroxyalkyl,

*n* is an integer of at least 1 when the compound is a disulphonium compound and is an integer of at least 2 when the compound is a monosulphonium compound, and Z is an anion but does not exist when one of $X_1$ and $X_2$ itself contains an anionic group, is present in the developer employed or in the photographic element in an amount sufficient to increase the initial rate of development and to stabilize the speed upon prolonged development.

2. Method according to claim 1, wherein the sulphonium compound is present in the silver halide lith emulsion.

3. Method according to claim 1, wherein development occurs by means of a hydroquinone-formaldehyde bisulphite developer.

4. Method according to claim 1, wherein the developer and/or the silver halide emulsion comprises a polyoxyalkylene compound.

5. Method according to claim 1, wherein $X_1$ and $X_2$ are hydroxyalkyl.

6. Method according to claim 1, wherein R is alkyl.

7. Method according to claim 1, wherein *n* is 1 and R is

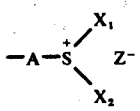

wherein A is $C_2$–$C_6$ alkylene, hydroxyalkylene or xylylene and each of $X_1$ and $X_2$ are alkyl of which at least one carries a hydroxy or sulpho group.

8. A photographic element comprising a support and a light-sensitive silver halide lith emulsion containing at least about 50 mole % of silver chloride, at least about 5 mole % of silver bromide and from 0 to 5 mole % of silver iodide wherein the emulsion comprises a sulphonium compound corresponding to the formula:

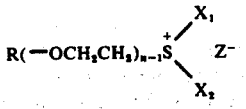

wherein:

each of $X_1$ and $X_2$ represents an alkyl group at least one of which carries a hydroxy, carboxy, sulpho or cyano group, R represents an alkyl group, an aryl group or the group

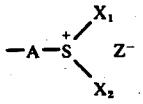

wherein A is a divalent organic group, or

R may represent hydrogen when both $X_1$ and $X_2$ are hydroxyalkyl,

*n* is an integer of at least 1 when the compound is a disulphonium compound and is an integer of at least 2 when the compound is a monosulphonium compound, and Z is an anion but does not exist when one of $X_1$ and $X_2$ itself contains an anionic group, in an amount sufficient to increase the initial rate of development and to stabilize the speed upon prolonged development.

9. A photographic element according to claim 8, wherein $X_1$ and $X_2$ are hydroxyalkyl.

10. A photographic element according to claim 8, wherein R is alkyl.

11. A photographic element according to claim 8, wherein *n* is 1 and R is

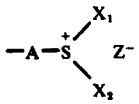

wherein A is $C_2$–$C_6$ alkylene, hydroxyalkylene or xylylene and each of $X_1$ and $X_2$ are alkyl of which at least one carries a hydroxy or sulpho group.

* * * * *